United States Patent [19]

Inoue et al.

[11] 4,269,623

[45] May 26, 1981

[54] COPPER ALLOY FOR RELIABLE ELECTRICAL CONNECTION

[75] Inventors: Sadao Inoue, Nikko; Tetsuya Umemura, Ichihara; Hiroshi Suzuki; Takashi Kuroyanagi, both of Yokohama, all of Japan

[73] Assignee: Furukawa Metals Company, Ltd., Tokyo, Japan

[21] Appl. No.: 77,123

[22] Filed: Sep. 19, 1979

[30] Foreign Application Priority Data

Sep. 19, 1978 [JP] Japan ..... 53-114884

[51] Int. Cl.[3] ..... C22C 9/00; C22C 9/04

[52] U.S. Cl. ..... 75/157.5

[58] Field of Search ..... 75/157.5

[56] References Cited

U.S. PATENT DOCUMENTS

| | | | |
|---|---|---|---|
| 2,155,406 | 4/1939 | Crampton et al. | 173/13 |
| 3,522,039 | 7/1970 | McLain | 75/157.5 |

*Primary Examiner*—L. Dewayne Rutledge
*Assistant Examiner*—Upendra Roy
*Attorney, Agent, or Firm*—Armstrong, Nikaido, Marmelstein & Kubovcik

[57] ABSTRACT

This invention relates to a copper alloy for reliable electrical connection comprising 0.5–3.0 wt% of Fe, 0.3–0.8 wt% of Zn and the balance being composed of Cu and impurities thereof, which is characterized by that it excels in connecting characteristics relative to connection by compression and, particularly does not permit a glow discharge and growth of cuprous oxide.

2 Claims, 7 Drawing Figures

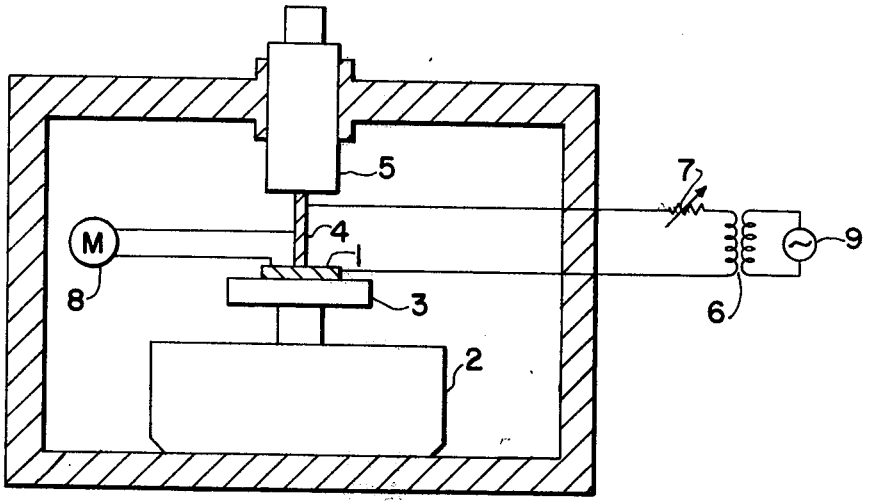
FIG. 2
FIG. 3a
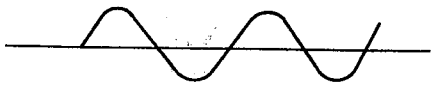
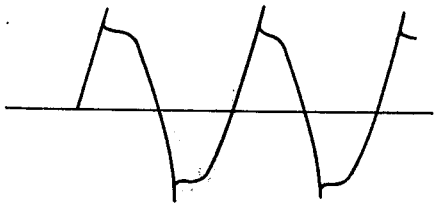
FIG. 3b

COPPER ALLOY FOR RELIABLE ELECTRICAL CONNECTION

BACKGROUND OF THE INVENTION

This invention relates to a copper alloy for reliable electrical connection comprising 0.5–3.0 wt% preferably 0.6–2.3 wt% of Fe, 0.3–0.8 wt% of Zn and the balance being composed of Cu and unavoidable impurities contained in electrolytic copper, and furthermore relates to a reliable connecter and a reliable connecting method using a copper alloy thereof.

BRIEF DESCRIPTION OF THE DRAWINGS

FIG. 2 is a schematic illustration of a method for measuring the glowing electrical connection and $Cu_2O$ growth electrical connection employed in the invention.

FIG. 3 shows variation in the voltage applied in accordance with the method shown in FIG. 2, FIG. 3(*a*) showing a normal voltage wave form and FIG. 3(*b*) a voltage wave form observed when glow discharge and growth of $Cu_2O$ takes place.

Figure 1A:
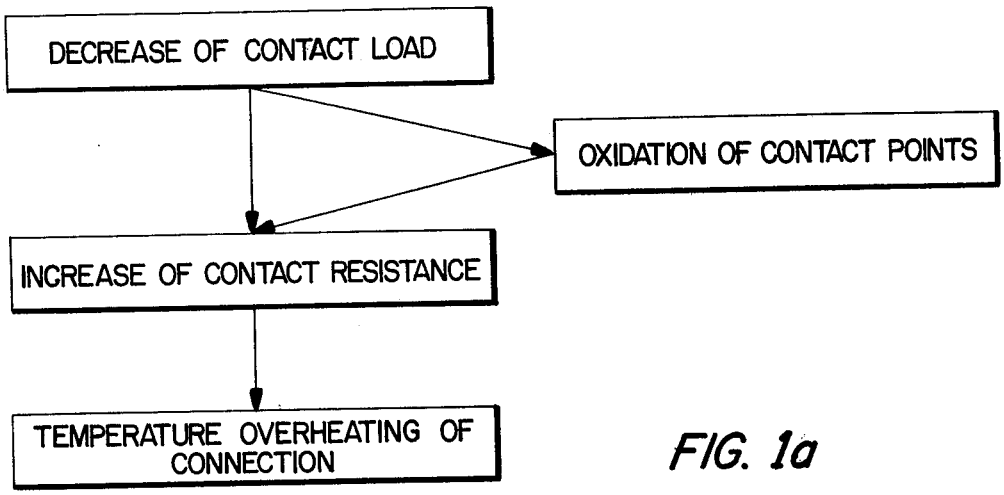
FIG. 1 shows mechanism of overheat at electrical connection, FIG. 1(*a*) representing the conventional concept and FIG. 1(*b*) the concept of the present invention.

In the drawings, a reference numeral 1 indicated a sample, 2 vibrator, 3 a vibrate plate, 4 a copper wire, 5 a copper wire holding/loading device, 10 and 10' pressing pieces, 11 a tightening screw, and 12 a copper wire.

DESCRIPTION OF THE PRIOR ART

Heretofore, brass parts have been used in general for connecting electric wiring while phosphor bronze has been used where especially high reliability is required. However, the deterioration and heat generation at such connection parts have come to present a problem. The electrical contact resistance at a connected part is determined by contact pressure. However, while electric wire and connecter are in use, the contact pressure at the connection parts tend to be decreased by creeping of the wire and a connecting piece applied thereto. The electrical contact resistance at the connection part then increases as the contact pressure decreases. The decrease in the contact pressure also causes oxidation of contact plane (contact spot) and this causes further increase in electrical contact resistance. It has been believed that, as a result of this, there takes place heat generation at the connection part due to Joule heating. To prevent this heat generation, there have been conducted various studies in terms of the structural arrangement of the connection part. However, all of such efforts have failed to maintain the initial contact pressure and thus failed to eliminate the probability of such heat generation. As for alloy having high strength and high conductivity, U.S. Pat. No. 3,522,039 specification discloses a copper alloy comprising Cu—1.5–3.5 wt% Fe—0.01–0.15 wt% P—0.03–0.20 wt% Zn.

As one of the copper alloy having the above composition, Cu—2 wt% Fe—0.15 wt% Zn—0.03 wt% P alloy is in use as conductive material.

However, for connection of wiring, this alloy does not much differ from the conventional alloys in respect of failure and overheating and thus has been little used for such a purpose. Since the conductivity of the brass material most conventionally used for connection of wiring is 20 to 30% IACS and that of the phosphor bronze, used for parts which need more reliability, does not exceed 10% IACS, it is believed that creep resistance, oxidation-resistant and strength are important for copper alloy for electrical connection rather than conductivity. Concerning glowing at electrical connection and $Cu_2O$— growthing therefrom, "NBSIR 76-1011, Exploratory Study of glowing Electrical Convections by William Meese and Robert W. Beausoliel October 1976 Final Report" reports as follows: "The report describes and characterizes with quantifiable electrical and thermal measures the extent to which *loose electrical connections* in residential-type branch circuits have overheated in the laboratory. With loose electrical connections, which conceivably could be inadvertently duplicated in field installations, but with otherwise normal installation and operating conditions, visible glows have been observed under laboratory test conditions in nominal 120 volt, 15 and 20 ampere branch circuits with both copper and aluminum wire. Characteristics of the glow condition are differentiated from arcing/sparking as sometimes observed in making or breaking electric circuits.

Glowing electrical connections may dissipate as much as 35 watts of power with a current of 15 amps in the circuit and as much as 5 watts with a current of 0.8 amp in the circuit. Temperatures over 750° F. were measured on the "break-off tab" of receptacles. Metal outlet boxes housing glowing connections in an insulated wall test set-up representative of a common type of residential construction attained temperatures in excess of 450° F. In laboratory tests under repetitive, intermittent and periodic cycles, a connection on a steel wire-binding screw of a receptacle open to the air had sustained glow conditions maintained for over 100 hours. Glowing connections will not perceptibly affect the electrical performance function of lights, appliances or other electrical loads, and will not "blow" fuses, trip circuit breaders or operate ground fault circuit interrupters."

As another report. "ELECTRICAL CONSTRUCTION AND MAINTENANCE February 1978 A MCGRAW-HILL PUBLICATION" describes as follows: "Glowing electrical connections appear to be most likely at copper-steel or aluminum-steel interfaces. Many wiring devices have steel wire-binding screws. Glows may develop at such interfaces even when there appears to be physical contact between the wire and a brass plate on wiring devices."

SUMMARY OF THE INVENTION

Figure 1B:
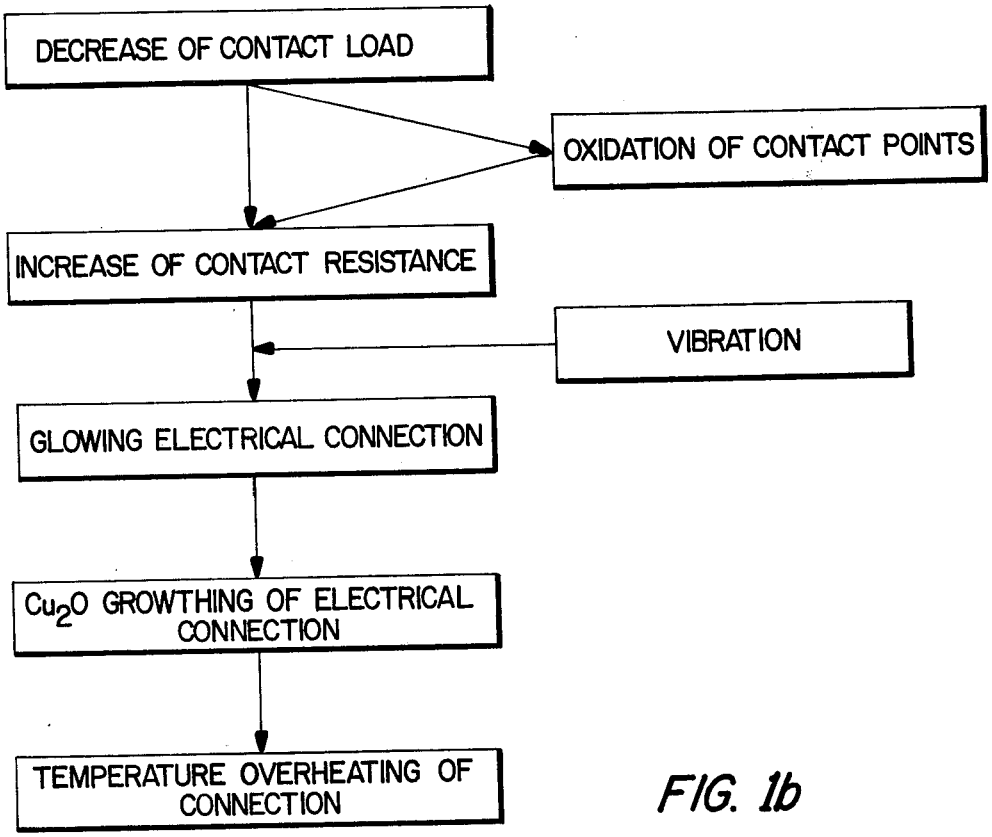

The present inventors conducted various studies based on this concept and have come to develop a novel copper alloy for reliable electrical connection, which shows no overheating, characterized in comprising 0.5–3.0% of Fe, 0.3–0.8% of Zn and the balance being Cu and impurities contained therein. Through these studies, it has been found that: Heat generation does not always take place in cases of loose contact due to creep that takes place during the use of the wiring or due to a decrease in contact pressure caused by inadequate connecting work. It is when external vibration or vibration caused by on and off of electric current supply to such an imperfect connection that there takes place creeping at contact faces of a connection part to cause a minor electric discharge called a glow discharge to take place at the contact faces. Then, this glow discharge causes cuprous oxide to grow and this cuprous oxide growing phenomenon causes heat generation. The heat generation cannot be explained by the conventional concept of heat generating mechanism which is as represented in FIG. 1(*a*). The inventors, therefore, thought that the mechanism shown in FIG. 1(*b*) might be applicable to this heat generation and conducted studies for the relation of glow discharge to the growth of cuprous oxide by using various alloys. Through these studies, it was found that the glow discharge is in an inverse relation to the cuprous oxide growth although the growing tendency of the cuprous oxide varies with the alloy used. Through further studies, it has been found that an alloy that excels in characteristics relative to glow discharge and cuprous oxide growth can be obtained by adding 0.5–3.0% of Fe and 0.5–3.0% of Zn to Cu.

In accordance with this invention, the addition quantity of Fe is set at a value between 0.5 and 3.0% and that of Zn between 0.3 and 0.8%, because: With Fe and Zn concomitantly included in Cu, excellent characteristics relative to glow discharge and growth of cuprous oxide can be simultaneously obtained. However, when the addition quantity of Fe is less than 0.5%, the characteristic relative to glow discharge degrades while the characteristic relative to the growth of cuprous oxide improves with increase in the addition quantity of Zn. Conversely, when the addition quantity of Fe exceeds 3%, the cuprous oxide growth characteristic is saturated while the glow discharge characteristic does not improve irrespective of any adjustment in the addition quantity of Zn. Further, when the addition Quantity of Zn is less than 0.3%, the glow discharge characteristic does not improve irrespective of any adjustment in the addition quantity of Fe. Conversely, when the addition quantity of Zn exceeds 0.8%, both the glow discharge and cuprous oxide growth characteristics come to degrade. An alloyed copper used in the present invention is allowed to contain impurities to a normal degree, because the performance of the alloy obtained therefrom is not seriously affected by such impurities. The objects, features and advantages of the invention will be more clearly understood from the following description of embodiments thereof when read in connection with the accompanying drawings.

EXAMPLE 1

Using a graphite crucible, electrolytic copper (Cu 99.96, As 0.005, Bi 0.001, Pd 0.005, S 0.010, Fe 0.01 wt%) was melted. After Fe and Zn were added to the melted copper, the mixture thus obtained was cast into a metallic mold to obtain an ingot measuring 60 mm in diameter. Then, after grinding the outside of this ingot, the ingot was hot extruded into a shape measuring 40 mm in width and 8 mm in thickness. Following this, a cold rolling process was carried out to obtain a copper alloy plate material measuring 2 mm in thickness. Table 1 shows the composition of each of copper alloy plates which were obtained in the above-stated manner. Some of these plate materials were annealed by heating them for 2 hours at 600° C. The glow discharge characteristic and the cuprous oxide growth characteristic of the annealed sample and those of the non-annealed sample (hereinafter will be called the coldworked sample) were measured. Table 2 shows the results of measurement.

Further, the glow discharge characteristic and the cuprous oxide growth characteristic shown in Table 2 were measured in the following manner as shown in FIG. 2 of the accompanying drawings: Referring to FIG. 2, each of samples 1 which were cut from the processed materials and the annealed materials into a shape measuring 2 mm in thickness was fixed to a vibration plate 3 attached to a vibrator 2. Then, a copper wire 4 was attached to a holding/loading device 5 and was brought into pressed contact with the surface of the vibrating sample 1. An electric current of 3 A was allowed to flow between the sample and the copper wire 4 by means of slide transformer 6 and a slide rheostat 7. Then, a voltage between the sample 1 and the copper wire 4 was observed with a memoriscope. When a glow discharge took place between the sample and the copper wire 4, a voltage wave form appeared at the memoriscope 8 as represented by FIG. 3(*a*) changed into a voltage wave form as represented by FIG. 3(*b*). The number of vibration registered at the time of the change in the voltage wave form was recorded as glow discharge characteristic. Further, concurrently with the glow discharge, the vibration was stopped to allow the growth of cuprous oxide to proceed. Then, 60 minutes after that, the sample 1 was removed from the vibration plate 3. Cuprous oxide grown on the surface of the sample 1 was completely removed and weighed to measure thereby the cuprous oxide growth characteristic. In the drawing, a reference numeral 9 indicates an AC power source. Further, the general characteristics shown in Table 2 were determined on the samples which were cut into a size measuring 10 mm in width and 100 mm in length.

TABLE 1

| Alloys | No. | Composition of alloy (%) Fe | Zn | Cu |
|---|---|---|---|---|
| Invented alloy | 1 | 0.6 | 0.3 | The rest |
| " | 2 | " | 0.5 | " |
| " | 3 | " | 0.8 | " |
| " | 4 | 1.0 | 0.3 | " |
| " | 5 | " | 0.4 | " |
| " | 6 | " | 0.7 | " |
| " | 7 | 1.6 | 0.3 | " |
| " | 8 | " | 0.4 | " |
| " | 9 | " | 0.5 | " |
| " | 10 | 2.0 | 0.3 | " |
| " | 11 | " | 0.4 | " |
| " | 12 | " | 0.5 | " |
| " | 13 | " | 0.7 | " |
| " | 14 | 2.3 | 0.3 | " |
| " | 15 | " | 0.4 | " |
| " | 16 | " | 0.5 | " |
| " | 17 | " | 0.7 | " |
| " | 18 | 2.6 | 0.4 | " |
| " | 19 | " | 0.5 | " |
| " | 20 | " | 0.6 | " |
| Comparison alloy | 1 | 0.6 | 0.2 | " |
| " | 2 | " | 1.2 | " |
| " | 3 | 2.6 | 0.2 | " |
| " | 4 | " | 1.5 | " |
| " | 5 | 0.3 | 0.5 | " |
| " | 6 | 4.0 | 0.5 | " |
| Conventional alloy | 1 | — | — | " |
| " | 2 | — | 10 | " |
| " | 3 | — | 20 | " |
| " | 4 | — | 35 | " |

TABLE 2

| No. | General characteristics: Tensile strength (kg/mm) Coldworked sample | Tensile strength Annealed sample | Conductivity (% IACS) Coldworked sample | Conductivity Annealed sample | Connection characteristics: Glow discharge charac-ter'c (cycle) Coldworked sample | Glow discharge Annealed sample | Cuprous oxide growth characteristic, (mg/hr.) Coldworked sample | Cuprous oxide Annealed sample |
|---|---|---|---|---|---|---|---|---|
| Invented alloy: | | | | | | | | |
| 1 | 47.2 | 27.0 | 35.1 | 76.9 | $3.5 \times 10^4$ | $3.3 \times 10^4$ | 41 | 42 |
| 2 | 47.3 | 27.5 | 34.8 | 75.8 | $3.3 \times 10^4$ | $3.5 \times 10^4$ | 41 | 42 |
| 3 | 47.5 | 28.0 | 34.0 | 76.0 | $2.2 \times 10^4$ | $2.0 \times 10^4$ | 43 | 44 |
| 4 | 49.2 | 28.2 | 30.1 | 69.4 | $2.2 \times 10^4$ | $2.2 \times 10^4$ | 42 | 43 |
| 5 | 49.8 | 28.6 | 30.1 | 69.4 | $2.1 \times 10^4$ | $2.5 \times 10^4$ | 42 | 44 |
| 6 | 50.0 | 28.8 | 29.8 | 69.0 | $3.5 \times 10^4$ | $2.9 \times 10^4$ | 45 | 45 |
| 7 | 49.9 | 29.3 | 25.1 | 68.3 | $2.2 \times 10^4$ | $2.5 \times 10^4$ | 39 | 40 |
| 8 | 49.9 | 29.3 | 24.9 | 68.3 | $2.3 \times 10^4$ | $2.6 \times 10^4$ | 39 | 40 |
| 9 | 50.1 | 29.4 | 24.9 | 68.1 | $2.2 \times 10^4$ | $2.3 \times 10^4$ | 40 | 41 |
| 10 | 50.3 | 31.4 | 24.1 | 65.2 | $2.0 \times 10^4$ | $2.1 \times 10^4$ | 38 | 39 |
| 11 | 50.4 | 31.6 | 24.1 | 65.1 | $2.9 \times 10^4$ | $2.6 \times 10^4$ | 38 | 39 |
| 12 | 50.4 | 31.6 | 24.0 | 65.0 | $3.1 \times 10^4$ | $2.9 \times 10^4$ | 39 | 39 |
| 13 | 50.6 | 31.8 | 23.9 | 64.5 | $3.1 \times 10^4$ | $2.7 \times 10^4$ | 39 | 39 |
| 14 | 51.4 | 32.1 | 23.8 | 63.1 | $3.2 \times 10^4$ | $2.8 \times 10^4$ | 35 | 35 |
| 15 | 51.4 | 32.1 | 23.7 | 63.9 | $3.2 \times 10^4$ | $2.9 \times 10^4$ | 35 | 35 |
| 16 | 51.6 | 32.2 | 23.6 | 63.0 | $2.9 \times 10^4$ | $2.9 \times 10^4$ | 35 | 35 |
| 17 | 51.8 | 32.3 | 23.4 | 62.9 | $2.9 \times 10^4$ | $2.6 \times 10^4$ | 36 | 36 |
| 18 | 53.2 | 34.1 | 23.5 | 56.5 | $1.8 \times 10^4$ | $2.1 \times 10^4$ | 31 | 31 |
| 19 | 53.4 | 34.1 | 23.4 | 56.0 | $1.6 \times 10^4$ | $2.1 \times 10^4$ | 31 | 31 |
| 20 | 53.4 | 34.2 | 23.0 | 55.6 | $1.5 \times 10^4$ | $2.1 \times 10^4$ | 32 | 33 |
| Comparison alloy: | | | | | | | | |
| 1 | 47.2 | 27.2 | 35.1 | 76.9 | $8.1 \times 10^2$ | $8.9 \times 10^2$ | 86 | 87 |
| 2 | 47.8 | 28.1 | 33.5 | 75.5 | $3.4 \times 10^3$ | $1.2 \times 10^4$ | 168 | 172 |
| 3 | 51.4 | 31.5 | 24.1 | 65.1 | $3.1 \times 10^2$ | $6.2 \times 10^2$ | 41 | 42 |
| 4 | 52.2 | 32.0 | 23.6 | 64.0 | $6.2 \times 10^3$ | $8.9 \times 10^3$ | 139 | 141 |
| 5 | 46.1 | 26.5 | 40.1 | 77.8 | $2.1 \times 10^3$ | $4.8 \times 10^3$ | 142 | 146 |
| 6 | 54.1 | 34.2 | 22.6 | 54.1 | $9.9 \times 10^2$ | $2.8 \times 10^2$ | 28 | 28 |
| Conventional alloy: | | | | | | | | |
| 1 | 36.5 | 23.6 | 98.5 | 101.2 | $3.5 \times 10^4$ | $3.6 \times 10^4$ | 230 | 225 |
| 2 | 42.0 | 27.3 | 43.0 | 44.5 | $8.2 \times 10^2$ | $9.0 \times 10^2$ | 83 | 82 |
| 3 | 49.6 | 27.8 | 31.7 | 33.2 | $3.8 \times 10^2$ | $4.0 \times 10^2$ | 56 | 59 |
| 4 | 56.2 | 32.2 | 27.1 | 28.9 | $2.2 \times 10^2$ | $2.5 \times 10^2$ | 56 | 57 |

Table 2 clearly indicates that the alloys No. 1–No. 20 of the present invention have glow discharge characteristic equal to that of pure copper which is represented by the conventional alloy No. 1 and which has the best glow discharge characteristic while the cuprous oxide growth characteristic of these alloys of the invention excels that of brass which is represented by the conventional alloy No. 4 and has been the best in the cuprous oxide growth characteristic. On the other hand, the comparison alloys No. 1 and No. 3 which have Zn added in less quantity and the comparison alloy No. 6 which has Fe added in larger quantity are inferior in the glow discharge characteristic though they excel in the cuprous oxide growth characteristic. The comparison alloys No. 2 and No. 4 which have Zn added in a larger quantity and the comparison alloy No. 5 which has Fe added in a smaller quantity are inferior in the cuprous oxide growth characteristic though they excel in the glow discharge characteristic.

Figure 4:
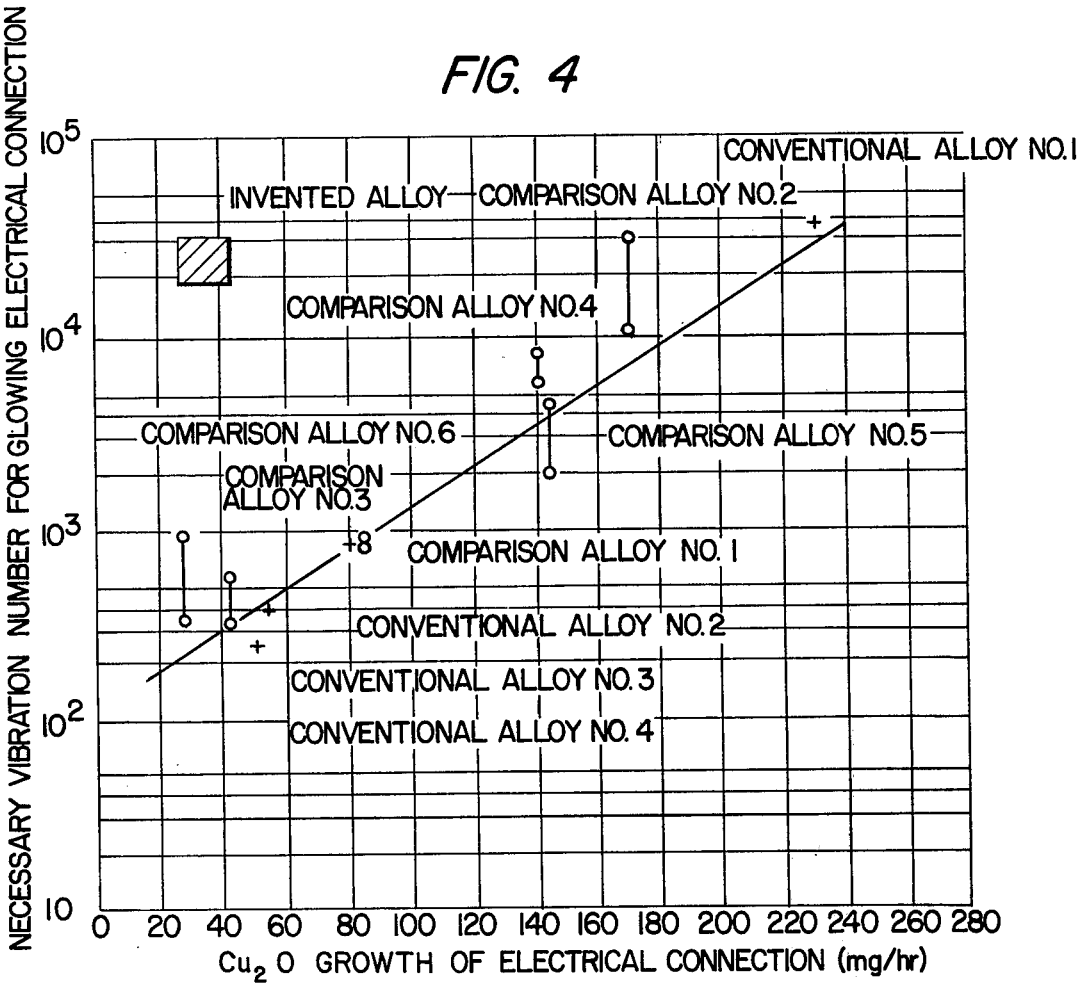
FIG. 4 is an illustration showing an interrelation between the glowing electrical connection and the $Cu_2O$ growthing electrical connection.

In the case of conventional alloys, the cuprous oxide growth characteristic degrades when the glow discharge characteristic is improved and, conversely, the glow discharge characteristic degrades when the cuprous oxide growth characteristic is improved. Whereas, the alloy of the present invention excels in both of these characteristics. To clearly show this, FIG. 4 illustrates the results of measurement shown in Table 2. The superiority of the invented alloy is apparent from FIG. 4. In the case of the conventional and comparison alloys, the number of vibration required for causing the glow discharge to begin is proportionate to the quantity of the growth of cuprous oxide and the alloy that has a greater vibration number (excels in the glow discharge characteristic) has a greater quantity of cuprous oxide growth showing an inferior cuprous oxide growth characteristic while the alloy having a smaller quantity of cuprous oxide growth (i.e. excels in cuprous oxide growth characteristic) is inferior in the glow discharge characteristic having a smaller number of the vibration. Whereas, every one of the alloys of the present invention has a great number of vibration and a small quantity of the cuprous oxide grown.

EXAMPLE 2

A screw tightening connecting part of the type generally in use as compression type connecter was prepared from each of the invented alloys, obtained in accordance with Example 1, comparison alloys and conventional alloys. These connecters were subjected to heat cycle tests to measure the rise of their temperature. The test results were as shown in Table 3. In Table 3, each denominator indicates the number of the connecting parts, subjected to the test and each numerator the number of connecting parts that generated heat.

Figure 5:
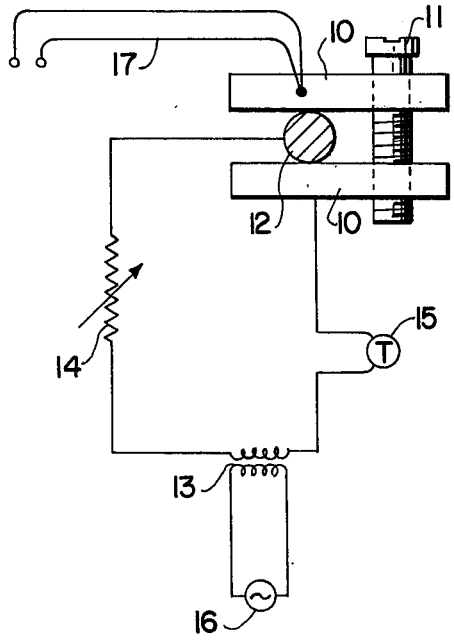
FIG. 5 is a schematic illustration of a method employed in carrying out a heat cycle test.

The heat cycle test was carried out in an ordinary manner as shown in FIG. 5. Referring to FIG. 5, pressing pieces 10 and 10' were made from the cold rolled material (measuring 2 mm in thickness) obtained in accordance with Example 1 and cut into a size measuring 10 mm in width and 30 mm in length. A tightening screw 11 was made from the hot rolled material in accordance with Example 1 and cut into a shape of 8 mm square; the 8 mm square material was processed to measure 4 mm through a hard drawn; and was then subjected to a threading process. These pressing pieces 10 and 10' and the tightening screw 11 were arranged to hold a copper wire of 2 mm diameter in a manner as shown in FIG. 5. Between the copper wire 12 and one pressing piece 10, a current of 30 A is allowed to flow intermittently at intervals of 40 minutes using a slide transformer 13, a slide rheostat 14 and a timer 15. Further, in the drawing, a reference numeral 16 indicates an AC power source 11 and 17 a thermocouple used for measuring temperature. The tightening screw 11 was tightened at tightening torque values of 2 kg-cm, 3 kg-cm and 7 kg-cm. For each alloy, 6 pieces of a connecting part made therefrom were subjected to the test to measure the number of pieces that had its temperature come to rise to 300° C. before the on-off cycle test number being 1000 cycles.

TABLE 3

| Alloy | No. | Number of connecting parts that reached 300° C. within 1000 cycles | | |
|---|---|---|---|---|
| | | 2 kg-cm | 3 kg-cm | 7 kg-cm |
| Invented alloy | 7 | 0/6 | 0/6 | 0/6 |
| " | 11 | " | " | " |
| " | 12 | " | " | " |
| " | 15 | " | " | " |
| " | 16 | " | " | " |
| " | 18 | " | " | " |
| Comparison alloy | 2 | 3/6 | 2/6 | " |
| " | 3 | 2/6 | 2/6 | " |
| " | 4 | 3/6 | 1/6 | " |
| " | 5 | 2/6 | 1/6 | " |
| Conventional alloy | 1 | 2/6 | 1/6 | " |
| " | 4 | 3/6 | 1/6 | " |

As apparent from Table 3, none of the connecting part made from the invented alloys had their temperature reach 300° C. even under the tightening torque of 2–3 kg-cm. Whereas, in the cases of the comparison alloys and the conventional alloys, the connecting part made from them came to have their temperature reach 300° C. when the tightening torque became less than 3 kg-cm thus bringing about a condition of imperfect connection. The connecting part made from the alloys of the present invention thus keeps their connection parts in a stable state without generating heat even under an imperfect connection condition. This advantage is attributable to the excellent glow discharge characteristic and also to the excellent cuprous oxide growth characteristic of the invented alloys.

Further, where a high degree of conductivity is required, the invented alloys can be annealed to give a conductivity of 55 to 75% IACS or thereabout with the above stated two characteristics unimpaired thereby. Where both a high conductivity and a high strength are required, the annealed alloy of the invention can be processed to a suitable degree to increase its strength without much lowering its high conductivity. The invented alloys have almost the same degrees of general characteristics as the conventional alloys. Therefore, connecting parts can be manufactured in the same manner as in the case of the conventional alloys. The present invention thus has salient advantages for industrial applications.

What is claimed is:

1. A copper alloy for giving a reliable connection in mechanical contact with an electric wire, which consists essentially of 0.5–3.0 wt.% of Fe, 0.3–0.8 wt.% of Zn, the balance consisting of Cu and impurities thereof.

2. A copper alloy for giving a reliable connection in mechanical contact with an electric wire in accordance with claim 1 which consists of 0.6–2.3 wt.% of Fe, 0.3–0.8 wt.% of Zn, the balance consisting of Cu and impurities thereof.

* * * * *